US008241452B2

(12) United States Patent
Obora et al.

(10) Patent No.: US 8,241,452 B2
(45) Date of Patent: Aug. 14, 2012

(54) REINFORCEMENT FIBROUS CORD HAVING EXCELLENT ADHESIVE STRENGTH AND METHOD OF PRODUCING SAME

(75) Inventors: Kenji Obora, Ibaraki (JP); Masashi Furukawa, Ibaraki (JP)

(73) Assignee: Teijin Fibers Limited, Osaka (JP)

( * ) Notice: Subject to any disclaimer, the term of this patent is extended or adjusted under 35 U.S.C. 154(b) by 680 days.

(21) Appl. No.: 12/373,232

(22) PCT Filed: Aug. 3, 2007

(86) PCT No.: PCT/JP2007/065668
§ 371 (c)(1),
(2), (4) Date: Jan. 9, 2009

(87) PCT Pub. No.: WO2008/018571
PCT Pub. Date: Feb. 14, 2008

(65) Prior Publication Data

US 2009/0233095 A1 Sep. 17, 2009

(30) Foreign Application Priority Data

Aug. 7, 2006 (JP) ..... 2006-214263

(51) Int. Cl.
*B32B 37/00* (2006.01)

(52) U.S. Cl. ..... 156/148; 156/155; 156/308.2

(58) Field of Classification Search ..... 156/155, 156/148, 308.2
See application file for complete search history.

(56) References Cited

U.S. PATENT DOCUMENTS

| | | | | |
|---|---|---|---|---|
| 2,431,977 | A * | 12/1947 | Alderfer | 28/168 |
| 2,898,665 | A * | 8/1959 | Salem et al. | 139/420 R |
| 2,932,901 | A * | 4/1960 | Salem et al. | 34/393 |
| 4,574,107 | A * | 3/1986 | Ferrari | 442/206 |
| 2005/0239360 | A1 | 10/2005 | Lam | |

FOREIGN PATENT DOCUMENTS

| | | | |
|---|---|---|---|
| JP | 52-121538 | A | 10/1977 |
| JP | 11-245614 | A | 9/1999 |
| JP | 2000-198148 | A | 7/2000 |
| JP | 2002-167250 | A | 6/2002 |
| JP | 2005-146433 | A | 6/2005 |
| JP | 2005-146434 | A | 6/2005 |
| JP | 2005-314860 | A | 11/2005 |
| JP | 2007-262601 | A | 10/2007 |

* cited by examiner

*Primary Examiner* — Jeff Aftergut
(74) *Attorney, Agent, or Firm* — Sughrue Mion, PLLC

(57) ABSTRACT

A reinforcement fibrous cord having excellent adhesive strength produced by impregnating a meshed cord fabric formed from warp yarns for reinforcement cords and weft yarns having a softening temperature or a melting temperature lower than any of the softening temperature, the melting temperature and the thermal decomposition-initiating temperature of the warp yarns, with adhesive agent, and heat-treating the fabric at the temperature equal to or higher than the softening or melting temperature of the weft yarn and lower than any of the softening temperature, the melting temperature and the thermal decomposition-initiating temperature of the warp yarns so that the weft yarns are self-broken while being fuse-adhered to the adhesive agent-impregnated warp yarns whereby projections caused by the broken residues of the weft yarns are formed on the warp yarns.

5 Claims, 2 Drawing Sheets

REINFORCEMENT FIBROUS CORD HAVING EXCELLENT ADHESIVE STRENGTH AND METHOD OF PRODUCING SAME

TECHNICAL FIELD

The present invention relates to a reinforcement fibrous cord having excellent adhesive strength, and a method of producing the same. More specifically, the present invention relates to a reinforcement fibrous cord having excellent adhesive strength, provided with many projections on the surface thereof, and a method of producing the reinforcement fibrous cord, wherein a rough-meshed fabric is woven from warp yarns formed of such fibrous cords and weft yarns formed of fibers which soften or melt at a temperature at which the warps do not soften, melt or thermally decompose, and is treated with adhesive and then heated to soften or melt the weft yarns alone, whereby the weft yarns are self-broken to leave the warp yarns impregnated with adhesive, which warp yarns are then individually separated from each other and collected to form a reinforcement fibrous cord.

BACKGROUND ART

The following documents are known as the background art of the present invention:

Patent document No. 1: Japanese Unexamined Patent Publication No. S52-121538

Patent document No. 2: Japanese Unexamined Patent Publication No. 2000-198148

Recently, a tire (known as a jointless tire) has been proposed, having a structure wherein no joints are formed in the circumferential direction, using single fibrous cords as reinforcement material for the reinforced layer of the tire.

A conventional method for producing the above-mentioned single cord has been known, wherein a fibrous cord wound on a bobbin is withdrawn therefrom, treated with an adhesive agent and then heat-set. However, this method is problematic in that operating and energy efficiency are low.

On the other hand, another method has been known, wherein a plurality of single cords are arranged parallel to each other, simultaneously treated with an adhesive agent and then heat-set. However, in this method, since a large number of cords arranged parallel to each other are used, there is a tendency for the cords to become entangled or broken in the process of applying adhesive. When the breakage of cords occurs, the broken cords entangle with the other cords, and the removal of the broken cords or the rearrangement of the remaining cords may be required. This results in a loss of cords, times and labors.

In Patent document No. 1, a method of producing a tire cord is disclosed wherein a plurality of warps consisting of yarns for single tire cords are woven with wefts at predetermined intervals in the longitudinal direction of the warps in order to provide a long mesh cord fabric (or tire fabric), the cord fabric is unwound and then the fabric is divided into a plurality of large individual sections having a width of 2 to 30 cm by expanding the fabric in the weft direction to increase intervals between the large individual sections and cutting the weft yarns between the large individual sections, each of the resultant plurality of large individual sections is divided into a plurality of small individual sections having a width of 0.5 to 5 cm by increasing the intervals between the small individual sections in the weft direction of the fabric and cutting the weft yarns between the small individual sections, and each of the warp yarns (single yarns) are collected from the each of the divided small individual sections, and wound.

In Patent document No. 2, a method of producing a tire cord from cord fabric is disclosed, wherein a long woven cord fabric in produced by weaving a number of single yarns for a tire cord with weft yarns woven into the warp yarns at intervals in the longitudinal direction thereof, and then subjected to adhesive treatment and heat set (weft yarns preliminarily treated with Teflon (trade mark) may be used for preventing the weft yarns from adhering to the warp yarns). In this method, when unwinding the wound cord fabric in one direction, the warp yarn becomes separated one by one from a edge of the fabric. At this time, positions at which the warp yarns are withdrawn from the fabric are arranged so that the distance between the withdrawing portion of the warp yarn and the unwinding portion of the cord fabric increases in the arrangement order of the warp yarns from the edge to the inner side. If all the warp yarns could not be withdrawn from the cord fabric in one procedure, the above-mentioned operations must be repeated, and in such a case, part of the weft yarns in the fabric from which the warp yarns have been withdrawn must be cut and removed.

In the above-mentioned prior art methods, means are necessary for withdrawing the warp yarns from the cord fabric (a rough-meshed fabric) containing fibrous cord yarns as the warp yarns, and for cutting and removing weft yarns. Accordingly, production is complicated and expensive, and the production process becomes complicated and difficult, resulting in increased production costs.

Regarding the reinforcement cords for rubber or resin, it has been required that the reinforcement cords have a high adhesive strength to a rubber or resin material. In the above-mentioned method, it is desirable that the warp yarns and the weft yarns do not adhere to each other so that the warp yarns are easily separable from the weft yarns. However, in order to satisfy such a requirement, the adhesive strength of the resultant fibrous cord to a rubber or resin material may be insufficient.

DISCLOSURE OF THE INVENTION

The present invention proposes a fibrous cord having excellent adhesive strength and a highly efficient method of producing the fibrous cord at low cost.

The reinforcement fibrous cord of the present invention having excellent adhesive strength comprises a fibrous cord yarn, an adhesive agent impregnated into the cord yarn, and a plurality of projections formed apart from each other alternately on one and opposite surfaces of the fibrous cord impregnated with adhesive agent in the lengthwise direction, wherein the projections are formed from fibrous pieces a plurality of fused spots of the fibrous pieces, a plurality of melted-and-solidified spots of the fibrous pieces and mixtures of two or more kinds thereof, each having a softening temperature or a melting temperature lower than all the softening temperature, the melting temperature and the thermal decomposition-initiating temperature of fibers from which the fibrous cord yarns are formed.

The method of producing a reinforcement fibrous cord of the present invention having excellent adhesive strength comprises the steps of; applying an a adhesive treatment to a meshed cord fabric consisting of warp yarns consisting of yarns for reinforcement cords and weft yarns consisting of yarns having the softening temperature or the melting temperature lower than any of the softening temperature, the melting temperature and the thermal decomposition-initiating temperature of the yarns for the warp yarns with an adhesive agent; heat-treating the resultant meshed cord fabric impregnated with the adhesive agent at the temperature equal to or higher than the softening or melting temperature of the yarns for the weft yarns and lower than all of the softening temperature, the melting temperature and the thermal decomposition-initiating temperature of the yarns for the warp yarns so that the weft yarns soften or melt and then adhere to portions of the warp yarns at which portions the warp yarns intersect with the weft yarns; an thereby cause the weft yarns to break at positions between every adjacent warp yarn to form projections caused by the broken residue of the weft yarns on the warp yarns at the intersection with the weft yarns; separating the resultant adhesive agent-impregnating warp yarns having the projections from each other; and collecting the separated warp yarns as fibrous cords, wherein the broken residues of the weft yarns from which C the projections are formed are in the shape of fiber pieces, a plurality of fused spots of the fiber pieces, a plurality of melted and then solidified spots of the fibrous pieces or mixtures of two or more kinds thereof.

In the method for producing a reinforcement fibrous cord having excellent adhesive strength of the present invention, the softening temperature or the melting temperature of the yarns for the weft yarns is preferably 20° C. or lower than all of the softening temperature, the melting temperature and the thermal decomposition-initiating temperature of the fibers for the fibrous cord.

In the method for producing a reinforcement fibrous cord having excellent adhesive strength of the present invention, preferably, the broken residues of the weft yarns are melted at each of the intersections of the warp yarns with the weft yarns to form covering layers.

In the method for producing the reinforcement fibrous cord of the present invention, since the meshed cord fabric is formed from warp yarns consisting of the fibrous cord yarns and the weft yarns having the softening temperature or the melting temperature lower than all of the softening temperature, the melting temperature and the thermal decomposition-initiating temperature of the warp yarns and treated with adhesive agent, the adjacent warp yarns are not adhered to each other with the adhesive agent. When this cord fabric is heat-treated, only the weft yarns are softened or melted to be self-broken, and thereby no procedure for separating the warp yarns from the weft yarns is necessary, and no procedure for collecting the residues of the weft yarns is necessary. Accordingly, it is possible to effectively and easily produce reinforcement fibrous cords at a low cost. The reinforcement fibrous cord according to the present invention has projections derived from the weft yarns and arranged apart from each other alternately on one and the opposite surfaces of the fibrous cord yarn impregnated with the adhesive agent, and thus, the above projections exhibit an anchoring effect when the reinforcement fibrous cord of the present invention is used for reinforcing a matrix material such as a rubber or resin material, thereby resulting in excellent adhesivity.

BEST MODE FOR CARRYING OUT THE INVENTION

Figure 1:
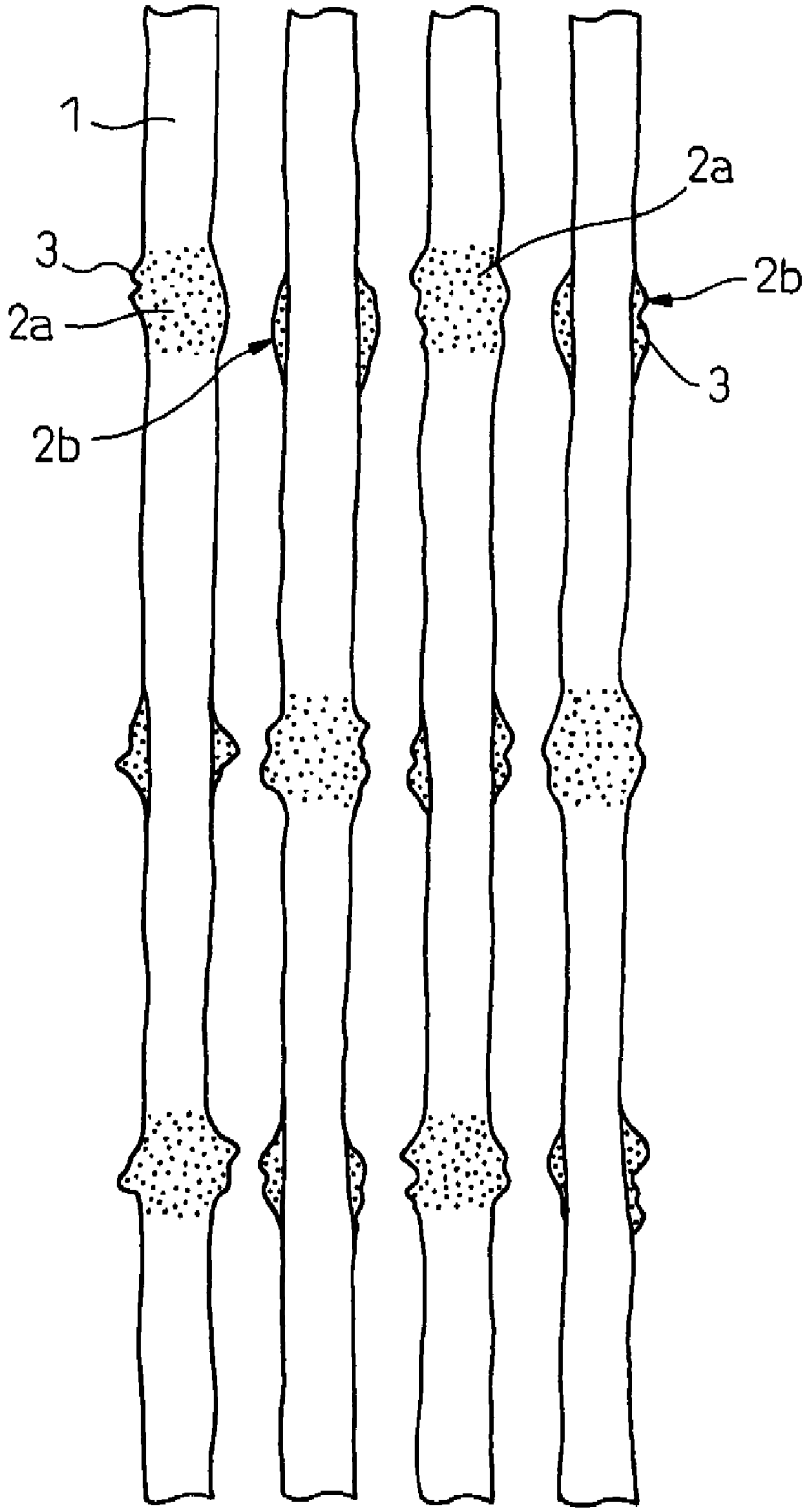
FIG. 1 is a plan view illustrating an example of a group of warp yarns on which weft yarns are melt-broken and adhered to the surfaces of the warp yarns by a heat treatment.

In the method of the present invention, first, a meshed cord fabric formed from warp yarns consisting of reinforcement fibrous cords and weft yarns consisting of fibrous yarns having a softening temperature or a melting temperature lower than any of the softening temperature, the melting temperature and the thermal decomposition-initiating temperature of the warp yarns, is used.

The meshed cord fabric is a fabric wherein all adjacent warp yarns and all adjacent weft yarns are spaced from each other at an interval.

The yarns for fibrous cord used as the warp yarns preferably comprise at least one type of fiber selected from a group consisting of thermoplastic fibers having a softening temperature of 100° C. or more and a melting temperature of 125° C. or more, such as polyamide fibers including nylon 6 or nylon 66 fibers; polyester fibers including polyethylene terephthalate, polyethylene naphthalate, polybutylene terephthalate or polytrimethylene terephthalate fibers, and the fibers having a thermal decomposition-initiating temperature of 130° C. or more, such as polyvinyl alcoholic fibers, rayon fibers or carbon fibers, and heat-resistant fibers such as aramid fibers.

Where two or more types of the above-mentioned fibers are used, the two or more types of fibers may have a hybrid type structure of yarns, for example, mixed fiber yarns, twisted union yarns or sheath-in-core type composite yarns, the yarns usable as warp yarns in the method of the present invention are preferably twisted yarns.

The warp yarns used for the meshed cord fabric of the present invention are preferably single yarns having a thickness preferably in a range from 560 to 2200 dtex, more preferably from 1100 to 1670 dtex, or plied yarns produced by paralleling 2 to 4 single yarns to each other and twisting the paralleled yarns. While there is no limitation in the thickness of a warp yarn, it is preferably in a range from 1100 to 5000 dtex, more preferably from 2200 to 3340 dtex. A thickness of individual fibers in the yarns for the warp yarns is appropriately established in accordance with the type of fibers and uses of the target cord. Generally, the individual fiber thickness is preferably in a range from 0.1 to 10 dtex, more preferably from 1 to 8 dtex.

The weft yarns usable for the meshed cord fabric as mentioned above consist of fibers having the softening temperature or the melting temperature lower than any of the melting temperature, the melting temperature and the thermal decomposition-initiating temperature of the warp yarn. The polymers usable for the fibers of the weft yarn are as follows: as low-melting point copolyesters, for example, copolyesters obtained by copolymerizing, as aromatic dicarboxylic acid component, terephthalic acid together with isophthalic acid and/or sulfoisophthalic acid are used; as low-melting point polyamides, for example, nylon 11 or nylon 12 is used, as low-melting point copolymerized polyamides, bipolyamides for example, nylon 6/66, nylon 6/610, nylon 6/612, nylon 6/11, nylon 6/12, nylon 66/610, nylon 66/612, nylon 66/11, nylon 66/12, nylon 610/612, nylon 610/11, nylon 610/12, nylon 612/11, and nylon 11/12, terpolyamides, for example, nylon 612/11/66, nylon 6/11/610, nylon 6/11/612, nylon 6/12/66, nylon 6/12/610, nylon 6/12/612 nylon 6/66/610, nylon 6/66/612, nylon 6/610/612, nylon 11/66/610, nylon 11/66/612, nylon 12/66/610, nylon 12/66/612, nylon 11/12/66, nylon 11/12/610, nylon 11/12/612 or nylon 66/610/612; and tetra component polyamides, for example, nylon 6/11/12/66, nylon 6/11/12/610, nylon 6/11/12/612, nylon 6/11/66/610, nylon 6/12/66/610, nylon 11/12/66/610, nylon 11/12/66/612 or nylon 12/66/610/612 are used. As other low melting point thermoplastic polymers include polyolefins, for example, polyethylene, polypropylene and copolymers thereof are used.

The softening temperature and the melting temperature of the fibers from which the weft yarns are formed, is preferably 20° C. or more, more preferably 50° C. or more, lower than any of the softening temperature, the melting temperature and the thermal decomposition-initiating temperature of the fibers from which the warp yarns are formed. Where the fibers from which the weft yarns are formed have the softening temperature or the melting temperature, the softening temperature or the melting temperature of the fibers for the weft yarns is preferably 50 to 250° C., more preferably 100 to 200° C. lower than the softening temperature or the melting temperature of the fibers for the warp yarns, by selectively using the warp yarns or the weft yarns having the above-mentioned difference in thermal characteristic, it is possible to soften or melt the weft yarn alone so that the weft yarns are broken between the adjacent warp yarns and the broken residues thereof adhere to the warp yarns, while maintaining a sufficient mechanical strength of the warp yarns that has been free from the thermal deterioration and not restricted from the adjacent ones. Some of the residue of the softened- or melt-broken weft yarns may be separated from the warp yarn and fall down.

The weft yarns used for the method of the present invention preferably have a thickness in a range from 33 to 560 dtex, more preferably from 56 to 167 dtex. A thickness of the individual fibers in the weft yarns is preferably in a range of from 1 to 7 dtex, more preferably from 2 to 4 dtex. If the weft yarns or individual fibers for the weft yarns are excessively thin, breakage and slip of yarns may occur in the weaving and finishing process. On the other hand, if it is excessively thick, the curvature of the warp yarns may increases and thus the tensile strength of the resultant fibrous cord decreases.

Preferably, both of the warp and weft yarns used for the method of the present invention are formed from, multifilament yarns. However, one or both of the warp and weft yarns may contain spun yarns if necessary.

In the method of the present invention the meshed cord fabric preferably includes, as warp yarns, polyethylene terephthalate multifilament yarns, a polyethylene naphthalate multifilament yarns, polyamide multifilament yarns, carbon multifilament yarns, aramid multifilament yarns, polyvinyl alcohol multifilament yarns, and/or rayon multifilament yarns, and as weft yarns, low melting point nylon multifilament yarns, particularly low melting point nylon multifilament yarns having a melting temperature or softening temperature preferably in a range of from 80 to 200° C., more preferably from 100 to 140° C.

In the present invention, the softening temperature, the melting temperature and the thermal decomposition-initiating temperature of the fibers for the warp and weft yarns are measured by a differential scanning type calorie meter in a nitrogen gas atmosphere, while heating the fibrous test piece at an increased temperature of 10° C./min.

In the method of the present invention, when the meshed cord fabric having a width in a range of from 140 to 160 cm is produced, the warp yarns in the number of from 1000 to 1500 are warped, the weft yarns are woven at intervals of 1.0 to 5.0 cm with the warp yarns. While the length of the target fabric is not limited, a preferable length thereof is from 800 to 2500 m.

In the method of the present invention, an adhesive agent is applied to the meshed cord fabric. The type amount etc. of the adhesive agent are appropriately established in accordance with the purpose of the target fibrous cord. For example, when a fibrous cord for rubber reinforcement is produced, adhesive agents containing an epoxy compound, an isocyanate compound, and a halogenated phenol compound and/or a resorcinol polysulfide compound are preferably used. In this case, for example, as a first adhesive-treatment liquid, a liquid mixture containing an epoxy compound and block-polymerized isocyanate latex is used, and after, the cord fabric is treated with the first adhesive-treated liquid, a first heat treatment is applied to the first adhesive-treated cord fabric. Then, as a second adhesive treatment liquid, a mixture (RFL liquid) of precondensate of resorcinol and formaldehyde, with rubber latex, is used to apply a second adhesive agent treatment to the cord fabric, and then a second heat treatment is preferably applied to the second adhesive-treated cord fabric. The temperatures and times of the first and second heat treatments may be appropriately established in accordance with type of the warp and weft yarns of the meshed cord fabric and compositions of the treatment liquids. In this case, the first and second heating temperatures and times are established so that the warp yarns are not damaged due to the softening, melting or thermal decomposition thereof but the weft yarns are solely self-broken due to the heat-softening or melting, and the adhesive agent is fully hardened and stabilized.

Generally, the heat treatment of the meshed cord fabric treated with adhesive agent is preferably carried out at a temperature of 20 to 150° C. more preferably 50 to 100° C. higher than the softening or melting temperature of the weft yarn. It should be noted that this temperature must be lower than any of the softening temperature, the melting temperature and the thermal decomposition-initiating temperature of the warp yarns. Also, the heat treatment time is preferably in a range from 15 to 150 sec, more preferably from 60 to 120 sec.

When the target fibrous cord is used for reinforcing a resin, for example, a polyester resin, the adhesive agent is preferably selected from a group of adhesive agents comprising an epoxy compound, an isocyanate compound, a halogenated phenol compound and/or a resorcinol polysulfide compound.

Generally, the amount of the adhesive agent applied to the cord fabric is in a range from 1 to 20% by weight, more preferably from 2 to 10% by weight, of the warp yarns (fibrous cord substrate).

In the method of the present invention, when the meshed cord fabric is impregnated with the adhesive agent, while appropriately adjusting—the amount of the impregnated adhesive agent to a desired value, and then heat-treated in the above-mentioned temperature condition, the weft yarns are heat-softened and adhere to the warp yarn at the intersecting portions of the warp yarns with the weft yarns. The weft yarns are self-broken due to tensile force, or the weft yarns are heat-melted to adhere the warp yarn at the intersecting portion thereof with the weft yarns, and self-broken due to shrinkage caused by the surface tension of the melted material. In this case, the residue (melted liquid) of the melt-broken weft yarns forms a covering layer on the surface of the intersecting portions with the warp yarns, and when solidified forms projections at the intersecting portions with the warp yarns. An embodiment thereof is shown in FIG. 1. In FIG. 1, melted residues of the weft yarns adhere to front side intersecting portions 2*a* and back side intersecting portions 2*b* of the warp yarns 1 in the meshed cord fabric with the weft yarns (not shown in FIG. 1). A portion of the residues permeates gaps (not shown) between the respective individual fibers from which the warp yarns 1 are formed and other portions thereof solidifies on the intersecting portions 2*a* and 2*b* to form covering layers 2, and as a result, projections 3 are formed at the intersecting portions of the warp yarns with the weft yarns. Since a number of the projections causes the surface area of the resultant fibrous cord to increase, the large number projections exhibit an anchoring effect to improve the reinforcing effect of the fibrous cord, when the fibrous cord is used as a reinforcement agent for rubber or resin materials.

Figure 2:
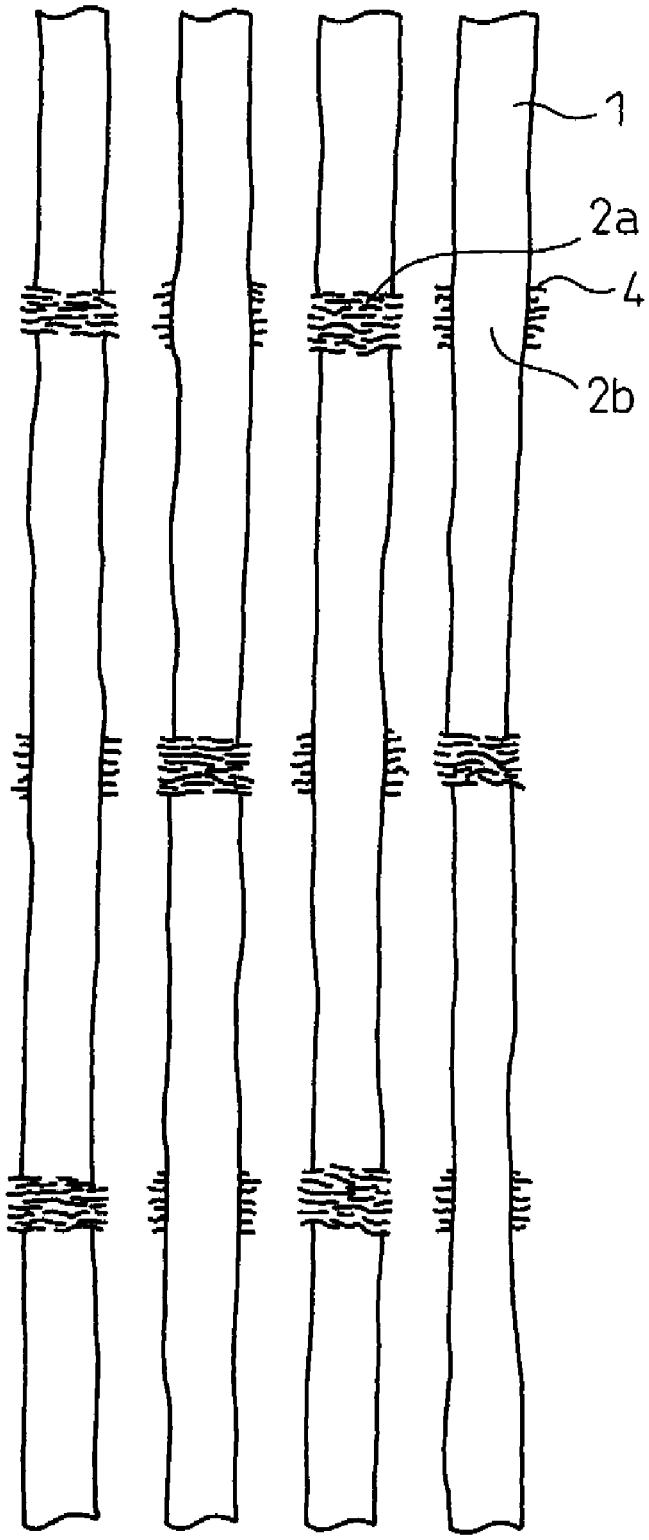
FIG. 2 is a plan view illustrating another example of a group of warp yarns on which weft yarns are self-broken and adhered to the surfaces of the warp yarns by the heat treatment.

FIG. 2 is a plan view illustrating another embodiment of a heat-treated meshed cord fabric produced according to the method of the present invention, after being heat-treated. In FIG. 2, the residues of the self-broken weft yarns due to the heat treatment form projections adhered to the intersecting portions 2*a* and 2*b* of the warp yarns 1 with the weft yarns (not shown), each in the form of a fibrous piece or a fuse-bonded spot of fibrous pieces (for example, of a ribbon shape, flat fiber shape or a slit-fiber shape). The ends 4 of the projections extends outward from the warp yarns. Even if the residues of the self-broken weft yarns are in the shape as shown in FIG. 2, the resultant fibrous cord exhibits a high anchoring effect and can be adhered to the rubber or resin matrix with a high adhesive strength.

When the weft yarn residues are adhered to the warp yarns, a total amount of the adhered weft yarn residue is preferably in a range from 0.01 to 3.0% by mass, more preferably from 0.05 to 0.7% by mass, faced on the mass of the warp yarns. If this amount is less than 0.01% by mass, the contribution of the weft yarn residues on the reinforcement effect of the fibrous cord may be insufficient. When it exceeds 3.0% by mass, when producing a target product, for example, a tire by using the fibrous cord, as a reinforcement member, the residues adhere to the production apparatus and the stability of the production process decreases.

After the heat treatment, the warp yarns are independent from each other, and thus, the warp yarns can be individually collected and wound.

According to the method of the present invention, when the meshed cord fabric formed from the warp yarns consisting of yarns for reinforcement fibrous cords and weft yarns consisting of fiber yarns having a softening temperature or a melting temperature lower than any of the softening temperature, the melting temperature and the thermal decomposition-initiating temperature of the warp yarns, is impregnated with an adhesive agent, and the adhesive agent-impregnating meshed cord fabric is subjected to a heat treatment at a temperature equal to or higher than the softening temperature or the melting temperature of the weft yarns but lower than any of the softening temperature, the melting temperature and the thermal decomposition-initiating temperature of the warp yarns, the weft yarns are softened and shrunk or melted to be self-broken, and the residue of the broken weft yarns adheres to the intersecting portions of the warp yarns with the weft yarns. Finally, the weft yarn residue-adhered warp yarns can be collected as fibrous cords impregnated with the adhesive agent.

When heat treatment is carried out at a temperature equal to or higher than the melting temperature of the weft yarns, but lower than the softening temperature, the melting temperature and the thermal decomposition-initiating temperature of the warp yarn, the weft yarns are melted and broken in the heat treatment, whereby the residues of the broken weft yarns adhere to the intersecting portions of the warp yarns with the weft yarns to form covering layers which form projections on the intersecting portions of the warp yarns.

If the fibers from which the weft yarns are formed are not sufficiently melted under heat treatment the resultant broken weft yarn residue may contain, fibrous pieces or fusion-bonded spots of fibrous pieces in a ribbon shape, flat fiber shape or a slit-fiber shape and portions of the resultant projections may extend outward from the adhering portions thereof.

The reinforcement fibrous cord having excellent adhesive strength of the present invention comprises yarns for the fibrous cord, an adhesive agent impregnated in the yarns for fibrous cords, and a plurality of projections formed from each other alternately on one and opposite surfaces of the yarns for the fibrous cord impregnating the adhesive agent, along the longitudinal direction of the yarns, wherein the projections are formed in the form of fibrous pieces, a plurality of fused spots of the fibrous pieces, a plurality of melted-and-solidified spots of the fibrous pieces and mixtures of two or more forms thereof, each having a softening temperature or a melting temperature lower than any one of the softening temperature, the melting temperature and the thermal decomposition-initiating temperature of fibers from which the fibrous cord yarns are formed, and the fibrous cord exhibit excellent adhesive strength.

In the reinforcement fibrous cord having excellent adhesive strength of the present invention, the above specific projection preferably forms covering layers comprising the melted-and solidified spots of the fibrous pieces on the adhesive agent-impregnating yarns.

EXAMPLES

The present invention will be illustrated in more detail by the following examples, wherein, in each of the Examples and Comparative examples, the melting temperature, the softening temperature and the thermal decomposition-initiating temperature of the fibers used for the warp and weft yarns, and the adhesive strength of the resultant reinforcement fibrous cord were measured as follows:

(1) Melting Temperature, Softening Temperature and Thermal Decomposition Initiating Temperature These temperatures were respectively measured by using a differential scanning calorie meter in a nitrogen atmosphere while heating test pieces at an increased temperature of 10° C./min.

(2) Adhesive Strength

The adhesive strength was measured in accordance with JIS L 1017; 3.1 T test (A) method.

A test cord piece was adhered to a non-vulcanized rubber plate under load, another non-vulcanized rubber plate was adhered thereon so that the test cord piece could not move, and the rubber plates were vulcanized to provide ten test specimens.

Each test specimen in which a test cord piece is embedded was fixed and the cord was withdrawn from the test specimen at a speed of 100 mm/min, the maximum stress of the cord was measured during the withdrawing procedure, and the average value of the ten test specimens was employed to represent the adhesive strength of the cords.

Example 1

As a warp yarn, a fibrous cord was used. The fibrous cord was prepared by paralleling two multifilament yarns consisting of polyethylene naphthalate filaments (1670 dtex/250 filaments, melting temperature; 272° C., (trademark: TEONEX, made by TEIJIN FIBERS K.K.) and twisting the paralleled yarn at a primary twist number of 40 turns/10 cm and then at a final twist number of 40 turns/10 cm. As a weft yarn, a multifilament yarn consisting of low-melting point nylon (110 dtex/12 filaments, melting temperature; 125° C.; trademark: FUROLM, made by UNITIKA FIBER K.K.) was used.

The warp yarns in the number of 1500 yarns were parallelized and warped, and the weft yarns were woven at intervals of 1.0 cm with the warp yarns to prepare a meshed cord fabric having a 160 cm width and a 1500 m length.

A first adhesive-treatment liquid was prepared in a composition consisting of an epoxy compound (trademark: DENACOL, made by NAGASE KASEI KOGYO K.K.) in an amount of 3 g (solid component)/liter, a block-isocyanate compound (trademark: S-3, made by MEISEI KAGAKU KOGYO K.K.) in an amount of 12 g (solid component)/liter, and a rubber latex (trademark: NIPOL, made by NIHON ZEON K.K.) in an amount of 85 g (solid component)/liter.

The meshed cord fabric was dipped into the first treatment liquid to be impregnated therewith in an amount of 2% by mass, dried at 130° C. for 100 seconds, and then subjected to a first draw-heating treatment at 240° C. for 45 seconds at a draw ratio of 1.035.

Separately, a second adhesive-treatment liquid comprising a rezorcin-formaldehyde-rubber latex (RFL) in a concentration of 200 g (solid component)/liter was prepared. The meshed cord fabric treated with the first adhesive-treatment liquid was dipped in the second treatment liquid to be impregnated therewith in an amount of 2% (solid component) by mass, dried at 100° C. for 100 seconds, then at 240° C. for 60 seconds, and subjected to a second draw-heating treatment at 240° C. for 60 seconds at a draw ratio of 1.035 and then, to a relax heat treatment at 240° C. for 60 seconds, after which the warp yarns were individually collected and wound.

During the first and second heat treatments, the low-melting point nylon weft yarns were self-broken and the broken weft yarn residue was fuse-adhered to the intersecting portions of the warp yarns with the weft yarns to form covering layers on the portions, whereby a number of projections were formed on the intersecting portions of the warp yarns with the weft yarns. The residues of the weft yarns adhered to the warp yarns were in an amount of 0.1% by mass based on the mass of the warp yarns.

After the relax heat treatment, no tight adhesion of the warp yarns to each other through the adhesive agent was found.

The adhesive strength of the resultant fibrous cords impregnated with the adhesive agent was 205 N/cm, which is sufficient for the practical reinforcement cords.

Example 2

Fibrous cords impregnated with an adhesive agent were produced in the same manner as in Example 1, except that, as warp yarns, aramid multifilament yarns (1670 dtex/1000 filaments, thermal decomposition-initiating temperature; 500° C., trademark: TOWALON, made by TEIJIN TOWALON K.K.) were used instead of the polyethylene naphthalate multifilament yarns in Example 1.

In the first and second heat-treatments, the low-melting point nylon weft yarns were melted and self-broken to form covering layers on the intersecting portions of the warp yarns with the weft yarns, whereby a number of projections were formed thereon. The residue of the weft yarns adhered to the warp yarns was in an amount of 0.2% by mass based on the mass of the warp yarns. No tight adhesion of the warp yarns to each other by the adhesive agent was recognized.

The adhesive strength of the resultant fibrous cord impregnated with the adhesive agent was 201 N/cm, which is sufficient for reinforcement cords in practice.

Example 3

Fibrous cords were produced in the same manner as in Example 1, except that as warp yarns, carbon multifilament yarns (2000 dtex/3000 filaments, thermal decomposition-initiating temperature; 500° C. or more; trademark: TENAX, made by TOHO TENAX K.K.) were used in place of the polyethylene naphthalate multifilament yarns in Example 1.

After the first and second heat treatments, the weft yarns consisting of low-melting point nylon were self-broken and adhered to the intersecting portions of the warp yarns with the weft yarns to form covering layers, whereby a number of projections were formed thereon. The residue of the weft yarns adhered to the warp yarns was in an amount of 0.1% by mass based on the mass of the warp yarns. No tight adhesion of the warp yarns to each other by the adhesive agent was recognized. The adhesive strength of the resultant fibrous cord impregnated with the adhesive agent was 210 N/cm, which is sufficient for reinforcement cords in practice.

Example 4

A fibrous cord was produced in the same manner as in Example 1, except that as warp yarns, nylon 66 multifilament yarns (1400 dtex/210 filaments, melting temperature; 265° C.; trademark: LEONA 66, made by ASAHI KASEI SENI K.K.) were used in place of the polyethylene naphthalate multifilament yarns in Example 1.

During the first and second heat treatments, the low-melting point nylon weft yarns were melted and self-broken, and the residue of the weft yarns formed covering layers on the intersecting portions of the warp yarns with the weft yarns. The residue of the weft yarns adhered to the warp yarns was in an amount of 0.07% by mass based on the mass of the warp yarns. No tight adhesion of the warp yarns to each other by the adhesive agent was recognized. The adhesive strength of the resultant fibrous cord impregnated with the adhesive agent was 225 N/cm, which is sufficient for reinforcement cords in practice.

Example 5

A fibrous cord was produced in the same manner as in Example 1, except that as warp yarns, polyvinyl alcohol multifilament yarns (1330 dtex/500 filaments, softening temperature; 220° C.; trademark: NEWLON, made by UNITIKA K.K.) were used in place of the polyethylene naphthalate multifilament yarns in Example 1. Also, temperatures of the first and second draw-heating treatments and the relax heat treatment was changed from 240° C. to 180° C., respectively. In the first and second heat treatments, the low-melting point nylon weft yarns were melted and self-broken, and formed covering layers in the form of projections at the intersecting portions of the warp yarns with the weft yarns. The residues of the weft yarns adhered to the warp yarns was in an amount of 0.3% by mass based on the mass of the warp yarns. No tight adhesion of the warp yarns to each other by the adhesive agent was recognized.

The bonding strength of the resultant fibrous cord impregnated with the adhesive agent was 203 N/cm, which is sufficient for reinforcement cords in practice.

Comparative Example 1

The same 1500 twisted polyethylene naphthalate multifilament yarns as used in Example 1 were parallelized and warped at intervals of 0.1 cm, and without being woven with weft yarns, subjected to an impregnation treatment with a first adhesive agent, a first heat treatment, an impregnation treatment with a second adhesive agent, a second heat treatment and a relax heat treatment. The yarns were brought into contact with and adhered to each other during the above-mentioned processes to generate yarn breakages. The adhesive strength of the resultant fibrous cords was 197 N/cm.

Comparative Example 2

A fibrous cord impregnated with an adhesive agent was produced in the same manner as in Example 1, except that as weft yarns, polyethylene naphthalate multifilament yarns (1100 dtex/250 filaments, melting temperature; 272° C., trademark: TEONEX, made by TEIJIN FIBERS K.K.) were used in place of the low-melting point nylon.

During the first and second heat treatments and the relax heat treatment, the weft yarns did not melt and the cord fabric was maintained in the structure of the meshed cord fabric. An attempt was made to withdraw the individual warp yarns from the meshed cord fabric impregnated with the adhesive agent. The separation of the warp yarns from the weft yarn was difficult, and operational efficiency was very poor. The adhesive strength of the resultant fibrous cord was 195 N/cm.

Industrial Applicability

In the method of the present invention, a number of projections are formed apart from each other on the surface of the fibrous cord impregnated with an adhesive agent. The projections exhibit an enhanced anchoring effect when the fibrous cord is used as an reinforcement material for rubber or resin materials, and enable the resultant fibrous cord to exhibit an enhanced adhesive strength. Also, in the method of the present invention, no tight adhesion of the cords to each other with the adhesive agent occurs, and the reinforcement fibrous cord having the above-mentioned structure can be easily and efficiently produced at a low cost.

The invention claimed is:

1. A method of producing a reinforcement fibrous cord having excellent adhesive strength, comprising the steps of:

applying an adhesive treatment with an adhesive agent to a meshed cord fabric consisting of warp yarns consisting of yarns for reinforcement cords and weft yarns consisting of yarns comprising at least one member selected from the group consisting of polyesters, polyamides and polyolefins each having a softening temperature or a melting temperature of 50° C. or more lower than any of the softening temperature, the melting temperature and the thermal decomposition-initiating temperature of the yarns for the warp yarns;

heat-treating the resultant meshed cord fabric impregnating the adhesive agent, at a temperature equal to or higher than the softening or melting temperature of the yarns for the weft yarns and lower than any of the softening temperature, the melting temperature and the thermal decomposition-initiating temperature of the yarns for the warp yarns so that the weft yarns are softened or melted and then adhered to portions of the warp yarns at which portions the warp yarns intersect with the weft yarns, and thereby the weft yarns are broken at positions between every adjacent warp yarns to form projections caused by the broken residue of the weft yarns on the warp yarns at the intersection with the weft yarns;

separating the resultant adhesive agent-impregnating warp yarns having the projections from each other; and collecting the separated warp yarns as fibrous cords, wherein the projections formed from the broken residues of the weft yarns are in the shape of fibrous pieces, a plurality of fused spots of said fibrous pieces, a plurality of melted-solidified spots of the fibrous pieces, or mixtures of two or more kinds thereof.

2. A method for producing a reinforcement fibrous cord having excellent adhesive strength as defined by claim 1, wherein the softening temperature or the melting temperature of the yarns for the weft yarns is 50 to 250° C. lower than any of the softening temperature, the melting temperature and the thermal decomposition-initiating temperature of the fibers for the fibrous cord.

3. A method for producing a reinforcement fibrous cord having excellent adhesive strength as defined by claim 1, wherein, the broken residue of said weft yarns are melted at each of the intersections of the warp yarns with the weft yarns to form covering layers.

4. A method for producing a reinforcement fibrous cord having excellent adhesive strength as defined in claim 1, wherein the yarns for the warp yarns comprise at least one member selected from (1) polyamide fibers and polyester fibers each having a softening temperature of 100° C. or more, a melting temperature of 125° C. or more and a thermal decomposition-initiating temperature of 100° C. or more; (2) polyvinyl alcohol fibers, rayon fibers and carbon fibers each having a thermal decomposition-initiating temperature of 130° C. or more and (3) aramid fibers.

5. A method for producing a reinforcement fibrous cord having excellent adhesive strength as defined in claim 1, wherein the yarns for the weft yarns comprise at least one member selected from copolyester fibers in which as copolymerizing aromatic dicarboxylic components, either or both of isophthalic acid and sulfoisophthalic acid are contained together with terephthalic acid, nylon 11, nylon 12, nylon 6/66, nylon 6/610, nylon 66/612, nylon 66/11, nylon 66/12, nylon 610/612, nylon 610/11, nylon 610/12, nylon 612/11, nylon 612/12, nylon 6/11/66, nylon 6/11/610, nylon 6/11/612, nylon 6/12/66, nylon 6/12/610, nylon 6/12/612, nylon 6/66/610, nylon 6/66/612, nylon 6/610/612, nylon 11/66/610, nylon 11/66/612, nylon 12/66/610, nylon 12/66/612, nylon 11/12/66, nylon 11/12/610, nylon 11/12/612, nylon 66/610/612, nylon 6/11/12/66, nylon 6/11/12/610, nylon 6/11/12/612, nylon 6/11/66/610, nylon 6/12/66/610, nylon 11/12/66/610, nylon 11/12/66/612, nylon 12/66/610/612, polyethylene, polypropylene and ethylene-propylene copolymers.

* * * * *